US009212521B2

(12) United States Patent
McCarty et al.

(10) Patent No.: US 9,212,521 B2
(45) Date of Patent: Dec. 15, 2015

(54) PORTABLE MODULAR GATE OR OBSTRUCTION SYSTEM AND METHOD

(71) Applicant: TYMETAL CORP., Greenwich, NY (US)

(72) Inventors: Brian E. McCarty, Greenwich, NY (US); Charles R. Alexander, Greenwich, NY (US)

(73) Assignee: Tymetal Corp., Greenwich, NY (US)

( * ) Notice: Subject to any disclaimer, the term of this patent is extended or adjusted under 35 U.S.C. 154(b) by 7 days.

(21) Appl. No.: 14/186,206

(22) Filed: Feb. 21, 2014

(65) Prior Publication Data

US 2015/0240561 A1 Aug. 27, 2015

(51) Int. Cl.

| | |
|---|---|
| ***E06B 11/00*** | (2006.01) |
| ***E05F 15/60*** | (2015.01) |
| ***E06B 11/02*** | (2006.01) |
| ***E06B 11/04*** | (2006.01) |

(52) U.S. Cl.

CPC ..... *E06B 11/00* (2013.01); *E05F 15/60* (2015.01); *E06B 11/021* (2013.01); *E06B 11/025* (2013.01); *E06B 11/026* (2013.01); *E06B 11/027* (2013.01); *E06B 11/04* (2013.01); *E06B 11/045* (2013.01)

(58) Field of Classification Search

CPC ..... E06B 11/00; E06B 11/021; E06B 11/025; E06B 11/026; E06B 11/027; E06B 11/04; E06B 11/045; E05F 15/60

See application file for complete search history.

(56) References Cited

U.S. PATENT DOCUMENTS

| | | | |
|---|---|---|---|
| 4,681,479 | A | 7/1987 | Wagner et al. |
| 5,097,790 | A | 3/1992 | Massey |
| 5,131,631 | A | 7/1992 | Cobbe |
| 5,782,039 | A | 7/1998 | Scherer et al. |
| 6,796,084 | B2 | 9/2004 | Gagnon |
| 7,268,701 | B2 | 9/2007 | Rohl |
| 2007/0126598 | A1 | 6/2007 | Carter et al. |
| 2008/0110413 | A1 | 5/2008 | Kobayashi et al. |

*Primary Examiner* — Long Pham

(74) *Attorney, Agent, or Firm* — Kenealy Vaidya LLP

(57) ABSTRACT

A portable gate module for selectively opening and closing a path through a secured perimeter can include a base structure, a gate support structure, a gate such as a gate panel structure with chain link or other fill structure, a power source, and a drive structure. The base structure can be configured to be removably positionable in the secured perimeter adjacent the path. The gate module can be configured as a pre-cast unit that can be quickly and easily placed into location at a remote or unimproved location such that a gate system can be quickly effected with minimal effort or expertise at the installation location.

21 Claims, 11 Drawing Sheets

PORTABLE MODULAR GATE OR OBSTRUCTION SYSTEM AND METHOD

BACKGROUND

1. Field

The presently disclosed subject matter relates to devices, systems, and processes useful as a portable modular gate or obstruction system.

2. Description of the Related Art

Existing perimeter security systems are typically permanent installations that require extensive site preparation and labor-intensive assembly to erect them. For example, after clearing the perimeter of vegetation and other obstructions, post holes are typically dug at spaced intervals along the perimeter to provide firm planting for posts that support the fencing structure.

Although limited modular gate systems are known, the design is typically directed to ease of installation in urban or suburban environments in which reduction of installation time can provide a cost savings to the contractor or other installer. Thus, once in place, the gate typically remains a part of the infrastructure and requires typical power supply and permanent fixturing for aesthetics.

However, certain secured sites may have restrictions that prohibit, or otherwise adversely alter, the typical construction of a permanently installed perimeter security system. Additionally, these typical perimeter security systems are prohibitively costly to secure a temporary site and require a large time investment for planning and construction.

SUMMARY

Accordingly, there is a long-felt need for a portable modular gate or obstruction system that can be easily and quickly set up and maintained. There is also a need for a modular gate system that can be used in a plurality of different locations and that is easily transported and installed. Still further, among other needs uncovered, it is apparent that a modular gate system that is relatively self sustaining (i.e., provides its own power source) and is quickly and easily implemented, is in desire.

According to one aspect of the disclosure, a portable gate module for selectively opening and closing a path through a secured perimeter can include: a base structure, a gate support structure, a chain link gate structure, a power source, and a drive structure. The base structure can be configured to be removably positionable in the secured perimeter adjacent the path. The base structure can have a first end configured to lie adjacent the path when the portable gate module is positioned in the secured perimeter adjacent the path. The base structure can have a second end spaced from the first end and configured to be spaced from the path when the portable gate module is positioned in the secured perimeter adjacent the path. The gate support structure can be secured to the base structure. The chain link gate structure can be cantilevered to the gate support structure and movable between an opened position where the gate is configured to open the path when the portable gate module is positioned in the secured perimeter adjacent the path and a closed position where the gate is configured to close the path when the portable gate module is positioned in the secured perimeter adjacent the path. The power source can be located on the base structure. The drive structure can be connected to the power source and coupled to the chain link gate to displace the gate between the opened positioned and the closed position.

According to another aspect of the disclosed subject matter, the portable gate module can include a gate panel having a frame structure that includes a first vertical beam and a second vertical beam and an in-fill spanning between the first vertical beam and second vertical beam. The in-fill can include chain link fence, but can also include pickets, a panel, and other known in-fill structures for fencing. The frame structure can include a first vertical beam and a second vertical beam connected together by at least one horizontal beam, wherein the first vertical beam, second vertical beam, and horizontal beam each have a cross sectional shape selected from the group consisting of circular, square, rectangular and polygonal.

According to another embodiment, the portable gate module can include a base structure that is a hollow plastic structure configured to be filled with a material when located adjacent the path. For example, the base could be filled with sand, water, dirt, mud, gravel, cement, or other materials and combinations of materials.

According to an aspect of the disclosed subject matter, a portable obstruction module for selectively opening and closing a path can include a base structure, a support structure, an obstruction structure, a power source, and a drive structure. The base structure can be made from a precast composition of material and configured to be removably positioned adjacent the path. The base structure can have a width extending in a direction away from the path when the base is positioned adjacent the path. The base structure can have a length extending in a direction substantially perpendicular with respect to the width. The base structure can include a height extending in a direction substantially perpendicular to both the width and length. The width can be greater than the length, and the length can be greater than the height. The support structure can be attached to the base structure. The obstruction structure can be mounted on the support structure and can be one of moveable and rotatable with respect to the support structure. The power source located on the base structure. The drive structure can be connected to the power source and coupled to the obstruction structure to displace the obstruction structure between an opened position where the obstruction structure is configured to open the path when the portable obstruction module is positioned adjacent the path and a closed position where the obstruction structure is configured to close the path when the portable gate module is positioned adjacent the path.

According to another aspect of the disclosed subject matter, a method for selectively opening and closing access to a path can include: providing a portable gate module that can include a base structure made from a precast composition of material, a gate support structure secured to the base structure, a chain link gate structure cantilevered to the gate support structure and movable between an opened position and a closed position, a power source secured to the base structure, and a drive structure connected to the power source and coupled to the gate to displace the gate between the opened positioned and the closed position; and moving the base structure and gate structure in unison and as a single unit to a location adjacent the path such that the chain link gate structure is configured to cross the path when in the closed position.

According to yet another aspect of the disclosed subject matter, a method for selectively opening and closing access to a path can include providing a portable gate module including a base structure, a gate support structure secured to the base structure, a gate panel structure having a frame cantilevered to the gate support structure and movable between an opened position and a closed position, a power source secured to the base structure, and a drive structure connected to the power source and coupled to the gate panel structure to displace the gate panel structure between the opened positioned and the closed position. The method can include moving the base structure and gate panel structure in unison and as a single unit to a location adjacent the path such that the gate panel structure is configured to cross the path when in the closed position. The method can also include sliding the gate panel structure relative to the gate support structure to cross the path into the closed position. Alternatively, the method can include rotating the gate panel structure relative to the gate support structure to cross the path into the closed position. The method can also include filling a hollow portion of the base structure with at least one of sand, water, cement, concrete, and mud after the step of moving the base structure and gate panel structure. In another aspect, the method can include providing a base structure that includes at least two apertures configured to receive forks from a forklift, and moving can include inserting forks into the at least two apertures and moving the portable gate module as a unit to a location adjacent the path such that the gate panel structure is configured to cross the path when in the closed position. The method can also include providing the frame of the gate panel with a first vertical beam at a first end of the gate panel structure and a second vertical beam at a second end of the gate panel structure, and an in-fill structure that is located between and spans the first vertical beam structure and the second vertical beam structure. The in-fill structure that is provided can include at least one of a chain link fence and pickets.

According to another aspect, the portable gate module can further include a wireless keypad in electrical communication with the power source and the drive structure.

According to another aspect of the disclosed subject matter, the portable gate module can be configured such that crash fortification can be accomplished with ease, and at various desired amounts. For example, components could be strengthened and support structures designed to withstand vehicle crashes by adding composite or other material (e.g., sand, sludge, etc.) to the base, gate, or post structures to provide variable fortification of the gate. In addition, crumple zones can be provided into any of the base structure, gate panel structure and/or gate post structure that causes the structure to receive and deplete energy from an impact while allowing a remaining damaged structure to maintain the closure status of the gate across the path. For example, a relatively elastic material can be provided within any or all of the structures that allows the structure(s) to elastically deform and then rebound after a crash incident.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which.

DETAILED DESCRIPTION OF EXEMPLARY EMBODIMENTS

Figure 1:
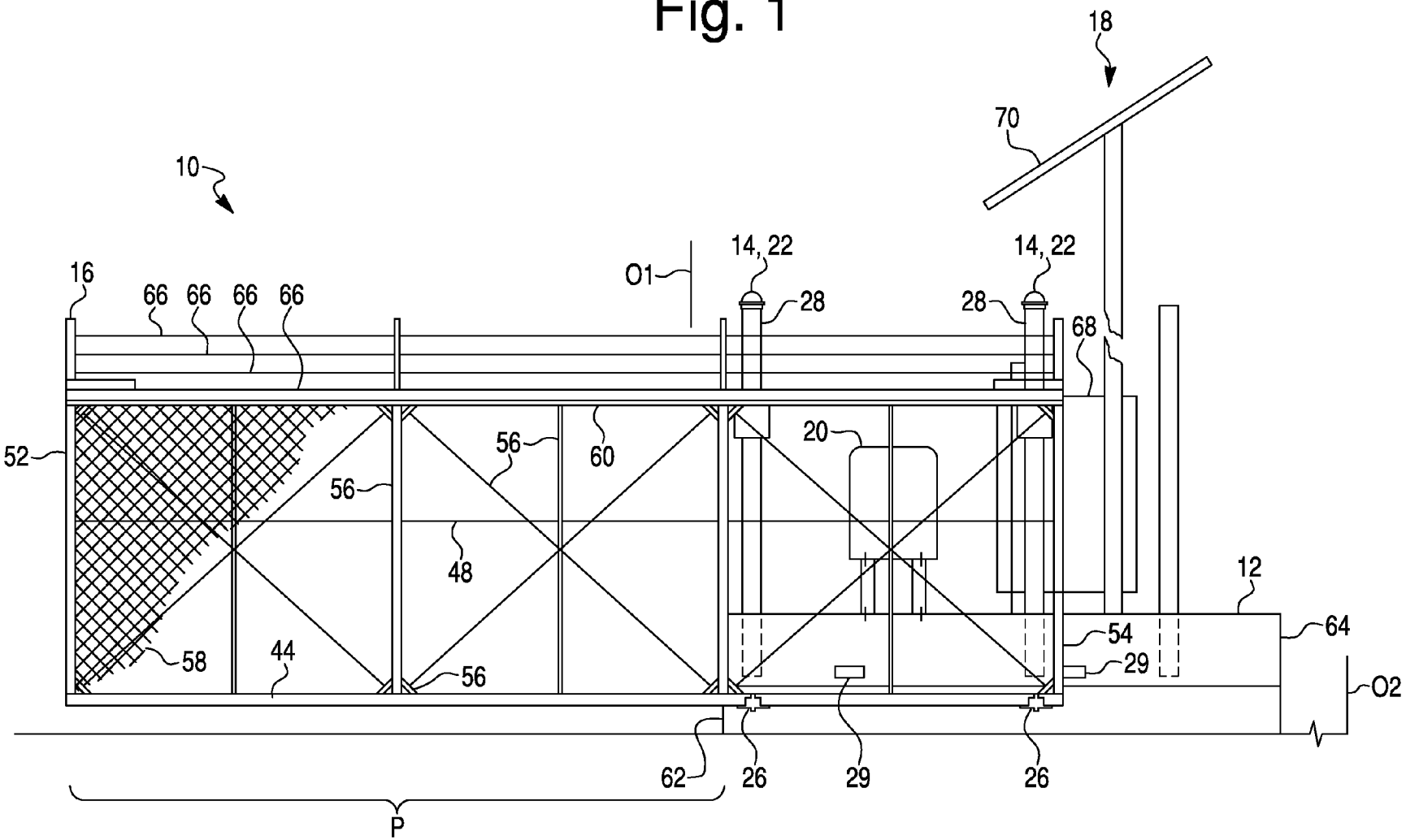
FIG. 1 is an elevation view of a first exemplary embodiment of a portable modular gate or obstruction assembly in accordance with the disclosed subject matter.
Figure 2:
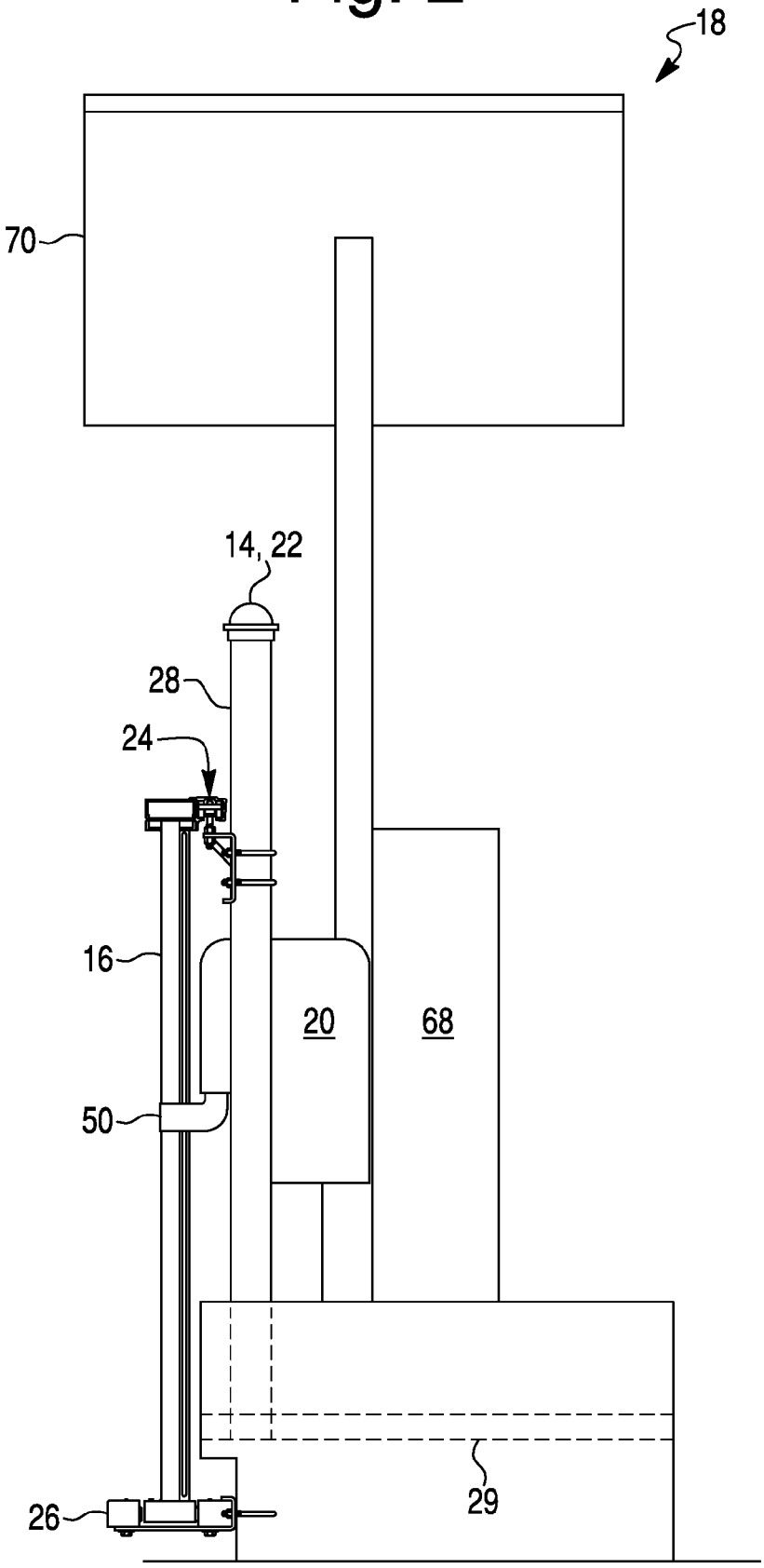
FIG. 2 is a side of the portable modular gate or obstruction assembly of FIG. 1.

FIGS. 1 and 2 illustrate an embodiment of a portable modular gate or obstruction assembly 10. The assembly 10 can be positioned across a path P through a secured perimeter to selectively open and close the path to vehicular and/or pedestrian traffic. The assembly 10 can include a base structure 12, a gate support structure 14, a gate or obstruction structure 16, a power source 18 and a drive structure 20 (schematically illustrated). The gate support structure 14, the power source 18 and the drive structure 20 can be attached to the base structure 12 to form a modular type of unit that can be moved and installed in a single movement or action. The gate or obstruction structure 16 can be connected to the gate support structure 14 to move between an opened position where the path P is unobstructed by the gate or obstruction structure 16 and a closed position where the gate or obstruction structure 16 prevents passage through the secured perimeter along the path P.

The base structure 12 can include a first end 62 and a second end 64. The base structure 12 can be dimensioned and of sufficient mass to provide a stable platform for the gate or obstruction structure 16 to move between the opened and closed positions. The base structure 12 can have a width extending in a direction away from the path when the base structure 12 is positioned adjacent the path P. The base structure 12 can have a length extending in a direction substantially perpendicular with respect to the width and parallel with a driving direction of a vehicle entering though the gate or "path crossing" direction. The base structure 12 can include a height extending in a direction substantially perpendicular to both the width and length, and upwards as shown in FIG. 1. For example, the height can extend upwards towards the solar panel 70 from a ground surface upon which the base structure 12 rests. The width can be greater than the length, and the length can be greater than the height. The base structure 12 can be of sufficient mass such that it is resistant to undesired displacement away from the path through the secured perimeter. The base structure 12 can be made from a precast composition of material, such as but not limited to concrete, an aggregate embedded in epoxy, or other appropriate pre-formable material composition. In the exemplary embodiment of FIG. 1, the base structure 12 can include a precast concrete slab. In an alternate embodiment, the base can be fabricated from bricks and mortar, cinder blocks and mortar, iron, steel, or other sufficiently heavy material to provide the desired level of security and operational integrity. In yet another embodiment, the base structure 12 can be made from plastic and filled with some type of ballast material(s), such as sand, sludge, oil, other materials that do not substantially expand or freeze upon temperature change, or other materials that may be common to the specific locale of installment, for example.

Figure 3:
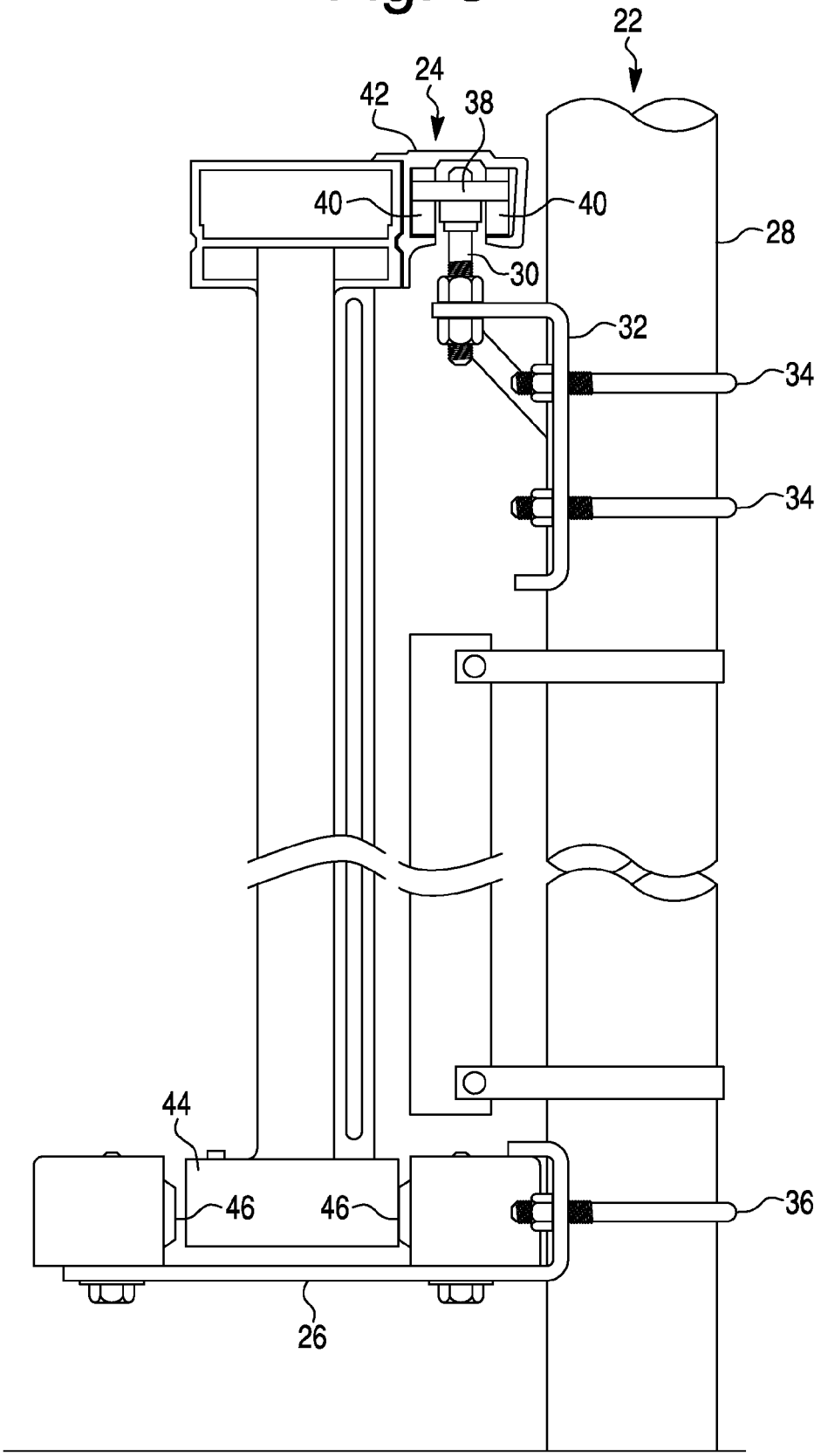
FIG. 3 is an enlarged partial view of FIG. 2 showing details of an exemplary gate support structure.

Referring to FIGS. 1-3, the gate support structure 14 can include a pair of support post assemblies 22. Each support post assembly 22 can include a hanger assembly 24 and a lower guide assembly 26 which supports the gate or obstruction structure 16 in a cantilevered configuration and guides the gate or obstruction structure 16 as the gate or obstruction structure 16 moves between the closed position and the opened position.

Each support post assembly 22 can include a support post 28 secured to the base structure 12 and which extends upwardly from the base structure 12. The gate support structure 14 can include a plurality of beams 29. The beams 29 can be made from at least one of metal, wood, and plastic or combinations thereof. The beams 29 can be precast in the base structure 12 such that the precast composition of material is in continuous contact with and completely surrounds an entire periphery of the beam. Although two beams 29 are illustrated in FIG. 1-3, any number of beams 29, including one, can be used based on the desired performance for the assembly 10. In another exemplary embodiment, the base structure 12 can be cast around the support post 28 such that the support post 28 is embedded in the base structure 12. In another exemplary embodiment, a receptacle can be embedded in the base structure 12 and the support post 28 can be attached to the receptacle via an appropriated number of mechanical fasteners, such as but not limited to a bolt, a screw, or a clamp. In another exemplary embodiment, the post 28 can be provided with a mounting flange through which fasteners can pass into the base 12.

Referring to FIG. 3, each hanger assembly 24 can include a truck 30 and a hanger bracket 32 secured to the truck 30 and a track 42 secured to and extending the length of the gate or obstruction structure 16. The hanger bracket 32 can be secured to the support post 28 by a plurality of U-bolts 34. The lower guide assembly 26 can be secured to the support post 28 by a U-bolt 36.

The truck 30 can include a pair of horizontal rollers 38 (only one is visible in FIG. 3) and four vertical rollers 40 (only two are visible in FIG. 3). The horizontal rollers 38 can engage the inner side walls of the track structure 42 and the vertical rollers 40 engage the upper and lower surfaces of the track structure 42. Thus, the hanger assembly 24 and the track structure 42 can cooperate to support the gate or obstruction structure 16 above the ground as the gate or obstruction structure 16 moves between the closed position and the open position along a linear path.

The lower guide assembly 26 can engage the sides (not numbered) of a lower member 44 of the gate or obstruction structure 16 to limit horizontal displacement of the gate or obstruction structure 16 toward and away from the support post 28 as the gate or obstruction structure 16 moves between the closed position and the opened position along the linear path. The lower guide assembly 26 can include an opposed pair of rollers 46 that can engage the lower member 44.

Referring to FIGS. 1 and 2, the drive structure 20 (schematically illustrated) can be mounted to the base structure 12. The drive structure 20 can be but is not limited to a chain drive mechanism or a cable drive mechanism that can engage a complimentary driven structure 48 on the gate or obstruction structure 16, such as but not limited to a drive chain or a cable. The drive structure 20 can drive the driven structure 48 in order to displace the gate or obstruction structure 16 between the closed position and the opened position along the linear path.

As shown in FIG. 2, the gate or obstruction structure 16 can include a support structure 50 at each end of the gate or obstruction structure 16 to which the complimentary driven structure 48 can be mounted. The support structure 50, as illustrated in FIG. 2 obstructs a view of the driven structure 48 and its engagement of the drive structure 20.

Referring to FIG. 1, the gate panel or obstruction structure 16 can include a first end 52, a second end 54, a frame structure 56, a chain link structure 58 and a wire structure 66. The chain link structure 58 can be secured to the frame structure 56 and can extend from the first end 52 to the second end 54 of the gate or obstruction structure 16. The frame structure 56 can include the lower member 44. The track structure 42 can be connected to the frame structure 56. In an alternate embodiment, the track structure 42 can be integrally formed with the upper member 60 of the frame structure 56.

As shown, the gate structure has a chain link as panel in-fill. However, it should be understood that this panel in-fill could include a variety of other options—such as pickets, expanded metal, wooden slats, plastic mesh, solid panels, etc. The gate panel 16 is a structure to hold whatever in-fill the owner desires. In addition, the gate panel structure 16 can be configured as a first and second vertical pole attached together by in-fill such as chain link fencing. The first and second vertical poles can be made of various shapes and materials, including circular, square, non-symmetrical, rectangular, polygonal and other cross-sectional shapes, and plastics, metals, woods, cements, composite materials, plastic bodies with fill therein, etc.

FIG. 1 shows the gate or obstruction structure 16 in the closed position. Here, the first end 52 of the gate or obstruction structure 16 can be spaced from the first end 62 of the base structure 12 and spaced from the hanger assembly 24 on the post 28 closest to the first end 62 of the base structure 12. The first end 52 of the gate or obstruction structure 16 can be cantilevered from the from the gate support structure 14 in a direction away from the base structure second end 64 and toward the base structure first end 62 when the gate or obstruction structure 16 is in the closed position. The second end 54 of the gate or obstruction structure 16 lies intermediate the base structure first end 62 and the base structure second end 64 when the gate or obstruction structure 16 is in the closed position. Thus, the gate or obstruction structure 16 can span the path P when the gate or obstruction structure 16 is in the closed position.

When the gate or obstruction structure 16 is in the opened position, the first end 52 of the gate or obstruction structure 16 can lie adjacent the first open position O1 and the second end 54 of the gate or obstruction structure 16 can lie adjacent the second open position O2. The first open position O1 can be adjacent the first end 62 of the base structure 12 and the second open position O2 can be spaced away from the second end 64 of the base structure 12 in a direction opposite from the first end 52 of the base structure 12. The first end 52 of the gate or obstruction structure 16 can lie adjacent the base structure first end 62 when the gate is in the opened position. The second end 54 of the gate or obstruction structure 16 can be cantilevered from the gate support structure 14 in a direction away from the base structure first end 62 and toward the base structure second end 64 when the gate or obstruction structure 16 is in the opened position. That is, the second end 54 of the gate or obstruction structure 16 is spaced from the base structure first end 62 in a direction away from the path P, such that the gate or obstruction structure 16 opens the path P.

With reference to FIGS. 1 and 2, the power source 18 can include a battery 68 (schematically illustrated) and a solar panel structure 70. The solar panel structure 70 can be in electrical communication with the battery 68 to provide charging capability to the battery 68. The battery 68 can be in electrical communication with the drive structure 20 to supply power for the operation of the drive structure 20. The battery 68 and the solar panel structure 70 can be mounted to the base structure 12.

All of the structures of the portable modular gate or obstruction assembly 10 can be mounted to the base structure 12 to allow for ease of installation and removal, when necessary. Further, the power supply for operating the portable modular gate or obstruction assembly 10 can also be portable and self-contained. These features can minimize time and labor costs for installation and removal, if necessary, of the portable modular gate or obstruction assembly 10 and can allow for installation in remote or unimproved locations.

Figure 4:
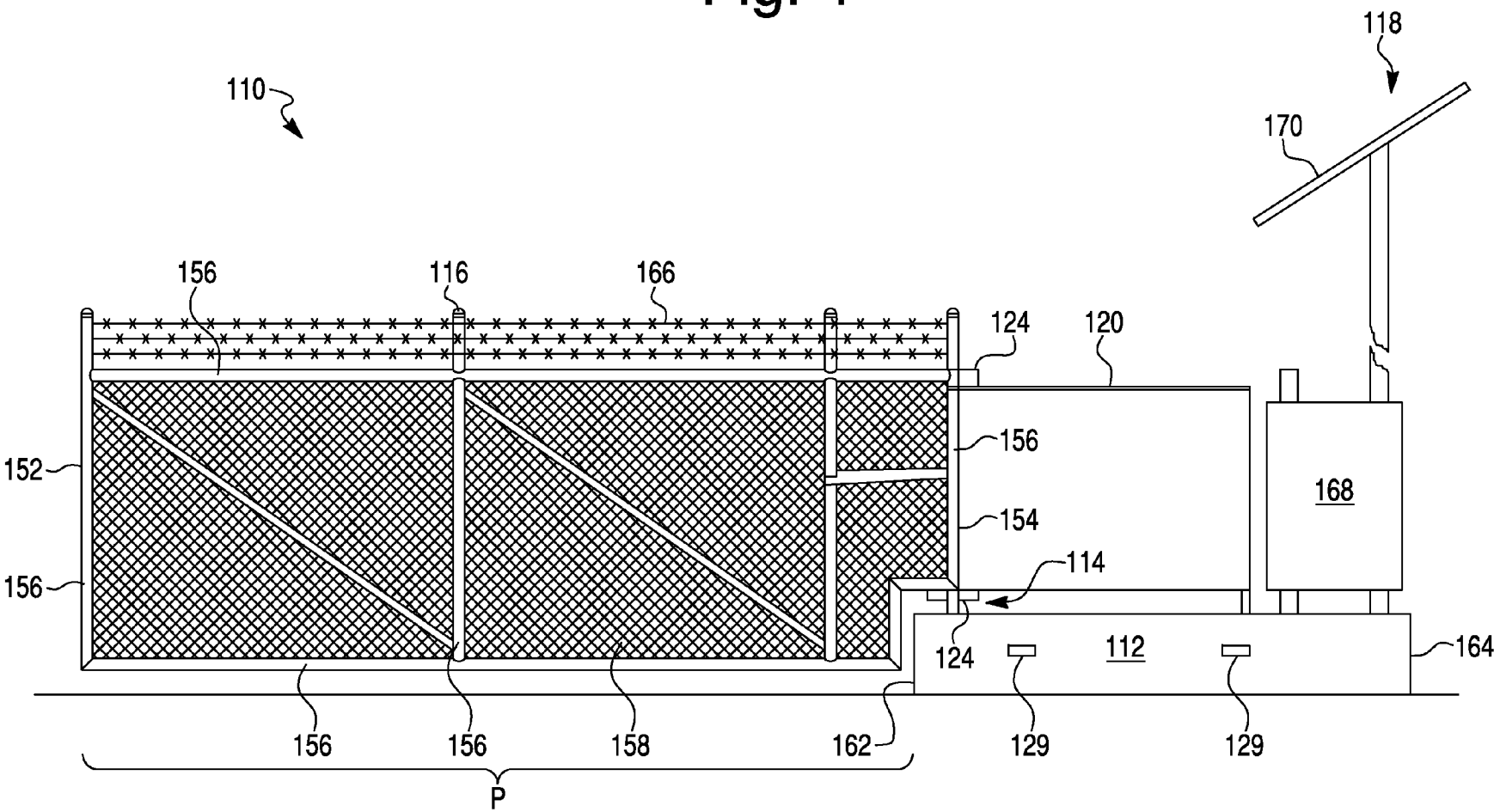
FIG. 4 is an elevation view of a second exemplary embodiment of a portable modular gate or obstruction assembly in accordance with the disclosed subject matter.
Figure 5:
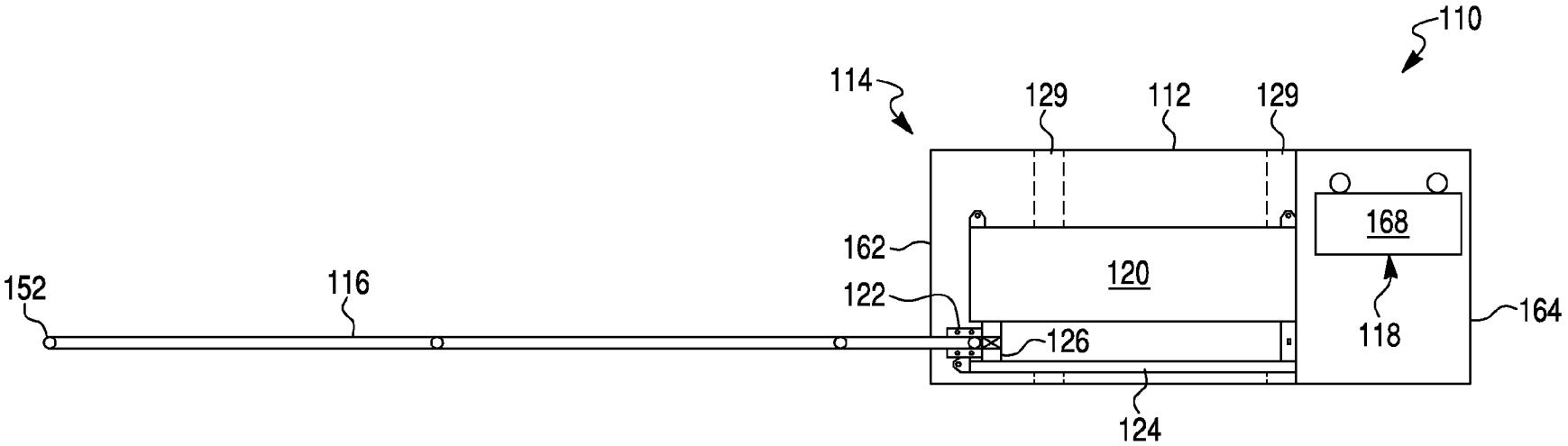
FIG. 5 is a plan view of the portable modular gate or obstruction assembly of FIG. 4.
Figure 6:
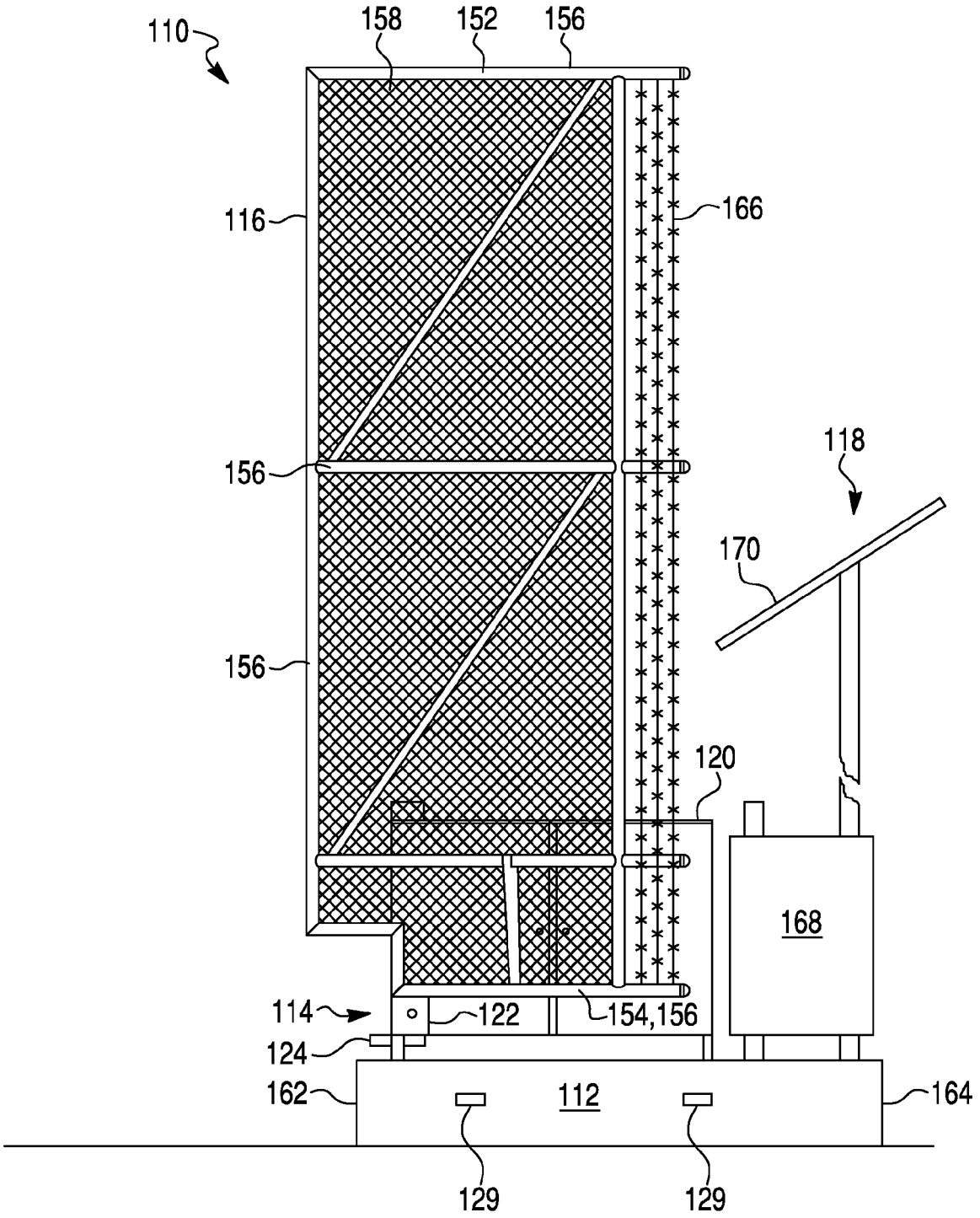
FIG. 6 is an elevation view of the portable modular gate or obstruction assembly of FIG. 4 showing the gate in the opened position.

FIGS. 4-6 illustrate a second exemplary embodiment of a portable modular gate or obstruction assembly 110. The assembly 110 can be positioned across a path P through a secured perimeter to selectively open and close the path to vehicular and/or pedestrian traffic. The assembly 110 can include a base structure 112, a gate support structure 114, a gate or obstruction structure 116, a power source 118 and a drive structure 120 (schematically illustrated). The gate support structure 114, the power source 118 and the drive structure 120 can be attached to the base structure 112. The gate or obstruction structure 116 can be connected to the gate support structure 114 to move between an opened position where the path P is unobstructed by the gate or obstruction structure 116 and a closed position where the gate or obstruction structure 116 prevents passage through the secured perimeter along the path P. FIGS. 4 and 5 show the gate or obstruction structure 116 in the closed position and FIG. 6 shows the gate or obstruction structure 116 in the opened position.

The base structure 112 can include a first end 162 and a second end 164. The base structure 112 can be dimensioned and of sufficient mass to provide a stable platform for the gate or obstruction structure 116 to move between the opened and closed positions. The base structure can 112 have a width extending in a direction away from the path when the base structure 112 is positioned adjacent the path P. The base structure 112 can have a length extending in a direction substantially perpendicular with respect to the width. The base structure 112 can include a height extending in a direction substantially perpendicular to both the width and length. The width can be greater than the length, and the length can be greater than the height. The base structure 112 can be of sufficient mass such that it is resistant to undesired displacement away from the path through the secured perimeter. The base structure 112 can be made from a precast composition of material, such as but not limited to concrete, an aggregate embedded in epoxy, or other appropriate pre-formable material composition. In the exemplary embodiment of FIG. 4-6, the base structure 112 can include a precast concrete slab. In an alternate embodiment, the base can be fabricated from bricks and mortar, cinder blocks and mortar, iron, steel, or other sufficiently heavy material to provide the desired level of security and structural integrity, etc.

Referring to FIGS. 5 and 6, the gate support structure 114 can include a connection structure 122 on the gate or obstruction structure 116 and a frame structure 124 mounted to the base structure 112. The connection structure 122 can be pivotally connected to the frame structure 124 so that the gate or obstruction structure 116 can move between the closed position and the opened position along an arcuate path.

The gate support structure 114 can also include a plurality of beams 129. The beams 129 can be made from at least one of metal, wood, stone, concrete, and plastic or combinations thereof. The beams 129 can be precast in the base structure 112 such that the precast composition of material is in continuous contact with and completely surrounds an entire periphery of the beam. Although two beams 129 are illustrated in FIG. 4-6, any number of beams 129, including one, can be used based on the desired performance for the assembly 110.

The drive structure 120 (schematically illustrated) can be mounted to the frame structure 124. In an alternate embodiment, the drive structure 120 can be mounted directly to the base structure 112. Referring to FIG. 5, the drive structure 120 can include a drive shaft 126 connected to the connection structure 122. The remainder of the drive structure 120 can be, but is not limited to, a gear drive structure, a kinematic drive structure, or an electric motor direct-drive structure such that the drive shaft 126 is rotated in order to displace the gate or obstruction structure 116 between the closed position and the opened position along the arcuate path. In an alternate embodiment, the drive shaft 126 can be omitted and replaced with a different drive structure such as but not limited to a cable structure, kinematic structure, or a counter-weight structure.

Referring to FIGS. 4 and 6, the gate or obstruction structure 116 can include a first end 152, a second end 154, a frame structure 156, a chain link structure 158 and a wire structure 166. The chain link structure 158 can be secured to the frame structure 156 and can extend from the first end 152 to the second end 154 of the gate or obstruction structure 116.

FIG. 4 shows the gate or obstruction structure 116 in the closed position. Here, the first end 152 of the gate or obstruction structure 116 can be spaced from the first end 162 of the base structure 112 and spaced from gate support structure 114. The first end 152 of the gate or obstruction structure 116 can be cantilevered from the from the gate support structure 114 in a direction away from the base structure second end 164 and toward the base structure first end 162 when the gate or obstruction structure 116 is in the closed position. The second end 154 of the gate or obstruction structure 116 lies adjacent the base first end 162 when the gate or obstruction structure 116 is in the closed position. Thus, the gate or obstruction structure 116 can span the path P when the gate or obstruction structure 116 is in the closed position.

When the gate or obstruction structure 116 is in the opened position, the first end 152 of the gate or obstruction structure 116 can be spaced upwardly away from the base first end 162. The first end 152 of the gate or obstruction structure 116 and the second end 154 of the gate or obstruction structure 116 can each extend from the base first end 162 toward the base second end 164. The first end 152 of the gate or obstruction structure 116 can be cantilevered from the gate support structure 114 in a direction upwardly away from the base structure first end 162 when the gate or obstruction structure 116 is in the opened position.

With reference to FIGS. 4-6, the power source 118 can include a battery 168 (schematically illustrated) and a solar panel structure 170. (The solar panel structure 170 is omitted from FIG. 6 for clarity of the illustration). The solar panel structure 170 can be in electrical communication with the battery 168 to provide charging capability to the battery 168. The battery 168 can be in electrical communication with the drive structure 120 to supply power for the operation of the drive structure 120. The battery 168 and the solar panel structure 170 can be mounted to the base structure 112.

All of the structures of the portable modular gate or obstruction assembly 110 can be mounted to the base structure 112 to allow for ease of installation and removal, when necessary. Further, the power supply for operating the portable modular gate or obstruction assembly 110 is also portable and self-contained. These features can minimize time and labor costs for installation and removal, if necessary, of the portable modular gate or obstruction assembly 110 and can allow for installation in remote or unimproved locations.

Figure 7:
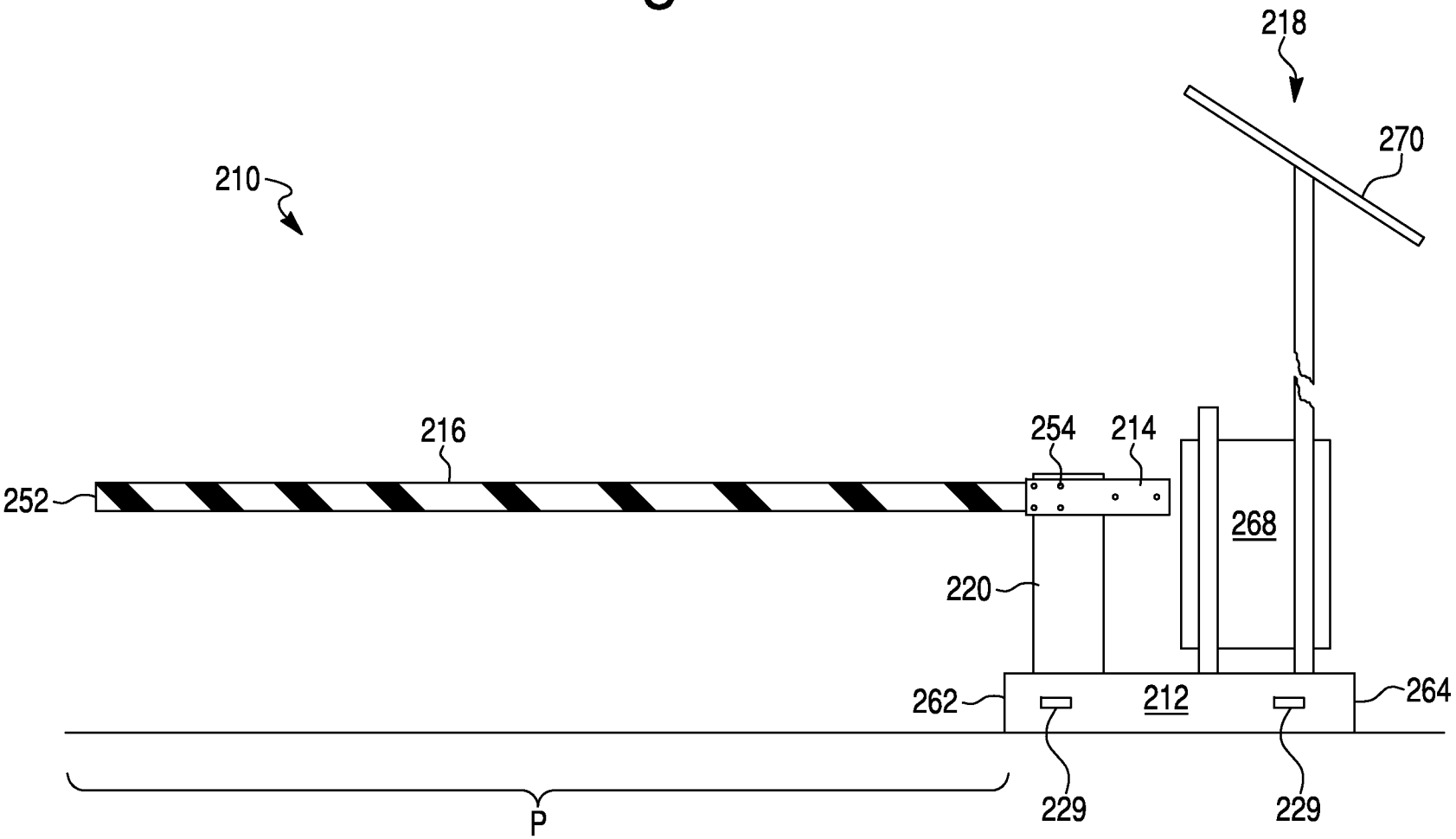
FIG. 7 is an elevation view of a third exemplary embodiment of a portable modular gate or obstruction assembly in accordance with the disclosed subject matter.
Figure 8:
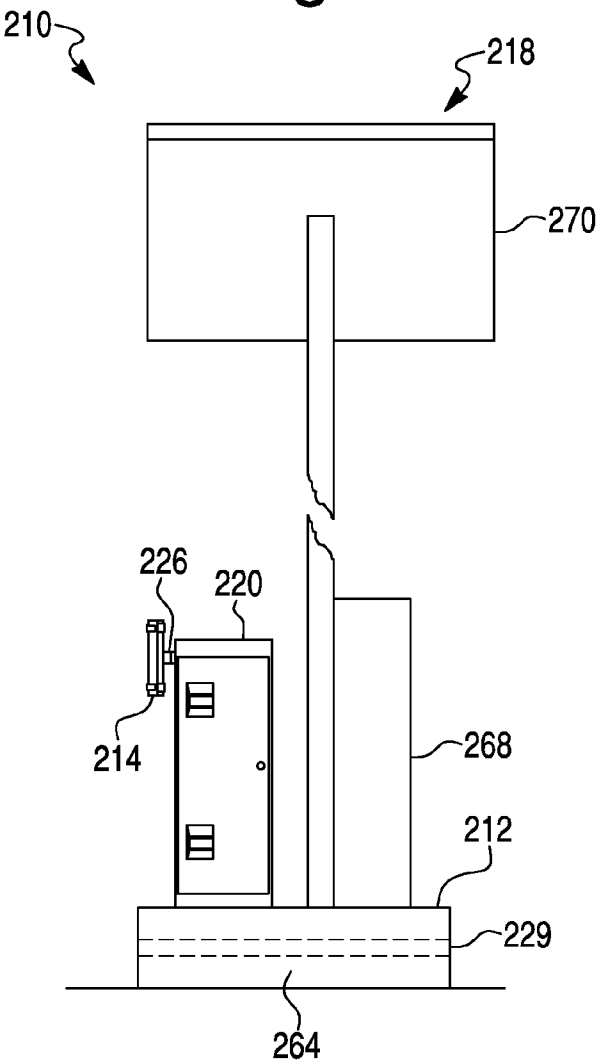
FIG. 8 is a side view of the modular gate or obstruction assembly of FIG. 7.

FIGS. 7 and 8 illustrate a third exemplary embodiment of a portable modular gate or obstruction assembly 210. The assembly 210 can be positioned across a path P through a secured perimeter to selectively open and close the path to vehicular and/or pedestrian traffic. The assembly 210 can include a base structure 212, a gate support structure 214, a gate or obstruction structure 216, a power source 218 and a drive structure 220 (schematically illustrated). The gate support structure 214, the power source 218 and the drive structure 220 can be attached to the base structure 212. The gate or obstruction structure 216 can be connected to the gate support structure 214 to move between an opened position where the path P is unobstructed by the gate or obstruction structure 216 and a closed position where the gate or obstruction structure 216 prevents passage through the secured perimeter along the path P. FIGS. 7 and 8 show the gate or obstruction structure 216 in the closed position. The gate or obstruction structure 216 can extend upwardly in a manner similar to the gate or obstruction structure 116 of FIG. 5.

The base structure 212 can include a first end 262 and a second end 264. The base structure 212 can be dimensioned and of sufficient mass to provide a stable platform for the gate or obstruction structure 216 to move between the opened and closed positions. The base structure can 212 have a width extending in a direction away from the path when the base structure 212 is positioned adjacent the path P. The base structure 212 can have a length extending in a direction substantially perpendicular with respect to the width. The base structure 212 can include a height extending in a direction substantially perpendicular to both the width and length. The width can be greater than the length, and the length can be greater than the height. The base structure 212 can be of sufficient mass such that it is resistant to undesired displacement away from the path through the secured perimeter. The base structure 212 can be made from a precast composition of material, such as but not limited to concrete, an aggregate embedded in epoxy, or other appropriate pre-formable material composition. In the exemplary embodiment of FIGS. 7 and 8, the base structure 212 can include a precast concrete slab. In an alternate embodiment, the base can be fabricated from bricks and mortar, cinder blocks and mortar, iron, steel, or other sufficiently heavy material to provide the desired level of security and structural integrity.

The gate support structure 214 can be formed as a bracket or other appropriate structure capable of supporting the gate or obstruction structure 216 in a cantilevered manner. The gate support structure 214 can also include a plurality of beams 229. The beams 229 can be made from at least one of metal, wood, stone, concrete, and plastic or combinations thereof. The beams 229 can be precast in the base structure 212 such that the precast composition of material is in continuous contact with and completely surrounds an entire periphery of the beam. Although two beams 229 are illustrated in FIG. 1-3, any number of beams 229, including one, can be used based on the desired performance for the assembly 210.

The drive structure 220 (schematically illustrated) can be mounted to the base structure 212. Referring to FIG. 8, the drive structure 120 can include a drive shaft 226 connected to the gate support structure 214. The remainder of the drive structure 220 can be, but is not limited to, a gear drive structure, a kinematic drive structure, or an electric motor direct-drive structure such that the drive shaft 226 is rotated in order to displace the gate or obstruction structure 216 between the closed position and the opened position along the arcuate path. In an alternate embodiment, the drive shaft 226 can be omitted and replaced with a different drive structure such as but not limited to a cable structure, kinematic structure, or a counter-weight structure.

The gate support structure 214 can be connected to the drive shaft 226 so that the gate or obstruction structure 216 can move between the closed position and the opened position along an arcuate path.

Referring to FIG. 7, the gate or obstruction structure 216 can include a first end 252, a second end 254, and a traffic arm 256. The traffic arm 256 can be secured to the gate support structure 214 and can extend from the first end 252 to the second end 254 of the gate or obstruction structure 216. The traffic arm 256 can be of any shape and made from any appropriate material, such as but not limited to wood, plastic or metal, etc.

FIG. 7 shows the gate or obstruction structure 216 in the closed position. Here, the first end 252 of the gate or obstruction structure 216 can be spaced from the first end 262 of the base structure 212 and spaced from gate support structure 214. The first end 252 of the gate or obstruction structure 216 can be cantilevered from the from the gate support structure 214 in a direction away from the base structure second end 264 and toward the base structure first end 262 when the gate or obstruction structure 216 is in the closed position. The second end 254 of the gate or obstruction structure 216 lies adjacent the base first end 262 when the gate or obstruction structure 216 is in the closed position. Thus, the gate or obstruction structure 216 can span the path P when the gate or obstruction structure 216 is in the closed position.

When the gate or obstruction structure 216 is in the opened position, the first end 252 of the gate or obstruction structure 216 can be spaced upwardly away from the base first end 262. The first end 252 of the gate or obstruction structure 216 and the second end 254 of the gate or obstruction structure 216 can each extend from the base first end 262 toward the base second end 264. The first end 252 of the gate or obstruction structure 216 can be cantilevered from the gate support structure 214 in a direction upwardly away from the base structure first end 262 when the gate or obstruction structure 216 is in the opened position.

With reference to FIGS. 7 and 8, the power source 218 can include a battery 268 (schematically illustrated) and a solar panel structure 270. The solar panel structure 270 can be in electrical communication with the battery 268 to provide charging capability to the battery 268. The battery 268 can be in electrical communication with the drive structure 220 to supply power for the operation of the drive structure 220. The battery 268 and the solar panel structure 170 can be mounted to the base structure 212.

All of the structures of the portable modular gate or obstruction assembly 210 can be mounted to the base structure 212 to allow for ease of installation and removal, when necessary. Further, the power supply for operating the portable modular gate or obstruction assembly 210 is also portable and self-contained. These features can minimize time and labor costs for installation and removal, if necessary, of the portable modular gate or obstruction assembly 210 and can allow for installation in remote or unimproved locations.

Figure 9:
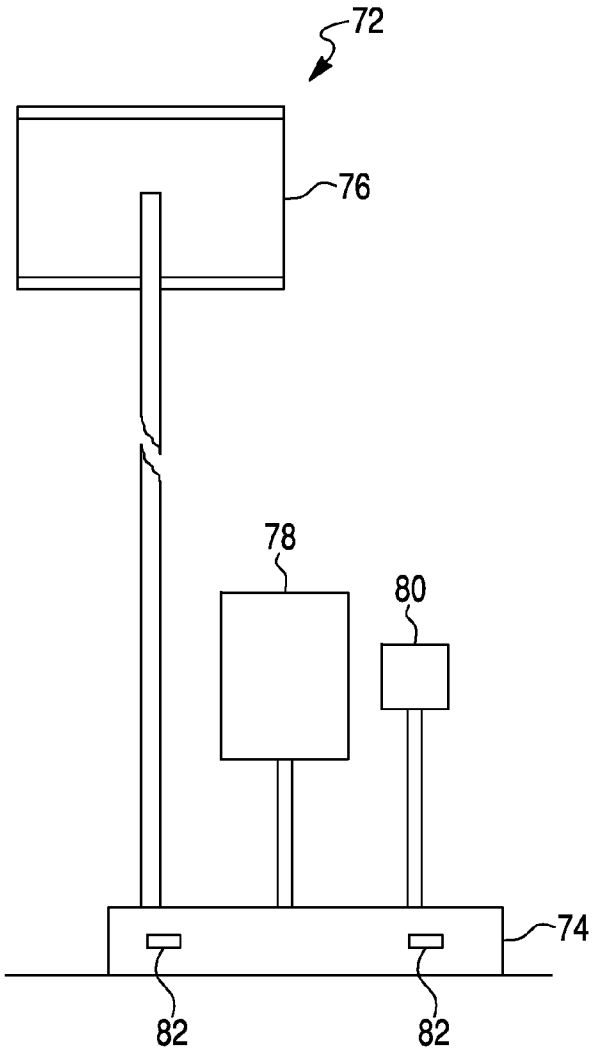
FIG. 9 is an elevation view of an alternate exemplary embodiment of a portable modular access control assembly in accordance with the disclosed subject matter.

A portable access control module 72 of FIG. 9 can be provided with any one of the portable modular gate or obstruction assembly 10, 110, 210 discussed above. The portable access control module 72 can include a base structure 74, a solar panel structure 76, a sign-in desk or control structure 78, and a wireless keypad 80.

The base structure 74 can be of sufficient mass such that it is resistant to undesired displacement away from the path through the secured perimeter. The base structure 74 can be made from a precast composition of material, such as but not limited to concrete, an aggregate embedded in epoxy, or other appropriate pre-formable material composition. In the exemplary embodiment of FIG. 9, the base structure 74 can include a precast concrete slab. In an alternate embodiment, the base can be fabricated from bricks and mortar, cinder blocks and mortar, iron, steel, or other sufficiently heavy material to provide the desired level of security or structural integrity.

The base structure 74 can include a plurality of beams 82. The beams 82 can be made from at least one of metal, wood, and plastic, concrete, stone or mixed composition thereof. The beams 82 can be precast in the base structure 74 such that the precast composition of material is in continuous contact with and completely surrounds an entire periphery of the beam. Although two beams 82 are illustrated in FIG. 9, any number of beams 82, including one, can be used based on the desired performance for the module 72. The solar panel structure 76, the sign-in desk or control structure 78 and the wireless keypad 80 can be secured to a respective one of the beams 82.

In another alternate embodiment, the solar panel structure 76, the sign-in desk or control structure 78, and the wireless keypad 80 can be secured to the base structure 74 by casting the material of the base structure around the solar panel structure 76, a sign in desk or control structure 78 and a wireless keypad 80. In another alternate embodiment, the solar panel structure 76, the sign in desk or control structure 78 and the wireless keypad 80 can be secured to fasteners affixed to the base structure 74.

The solar panel structure 76 can be in electrical communication with the wireless keypad structure 80. The wireless keypad 80 can be in electrical communication with the drive structure of any of the assemblies 10, 110, 210 described above to active the drive structure upon entry of a valid access code via the wireless keypad structure. In an alternate exemplary embodiment, the solar panel structure 76 can be omitted and the wireless keypad 80 can be in electrical communication with the power source structure and the drive structure of any one of the assemblies 10, 110, 210.

The sign-in desk or control structure 78 can receive and display information regarding the authorized passage of pedestrians and vehicular traffic through the path P. The structure 78 can also include computer controls, such as a programmable logic controller or other type of controller that assists or controls the operation of the gate system. The base 12 would include wireless or satellite communications capability that would allow the system 10 to communicate with remote operators or remote computers to control operation of the system. The control structure 78 can also include a camera or multiple cameras that would allow further remote operability for the system. For example, an operator at an off-location site can use a camera to view an entity requesting entry via the gate system. If authorized, the operator can wirelessly actuate the system to operate the gate structure for access (or denial of access) along the pathway in which the system is installed.

All of the structures of the portable access control module 72 can be mounted to the base structure 74 to allow for ease of installation and removal, when necessary. Further, the power supply for operating the portable access control module 72 is also portable and self-contained. These features can minimize time and labor costs for installation and removal, if necessary, of the portable access control module 72 and can allow for installation in remote or unimproved locations.

In an alternate embodiment, a fork pocket can replace each beam 29, 82, 129, 229 in the exemplary base structures 12, 74, 112, 212 described above. The fork pocket can be positioned and dimensioned to receive a fork of a forklift truck to facilitate removal and installation of each base structure 12, 74, 112, 212 described above. Any appropriate reinforcement can be added to the base structures 12, 74, 112, 212 to enhance the material strength around the fork pocket, as necessary.

Figure 10:
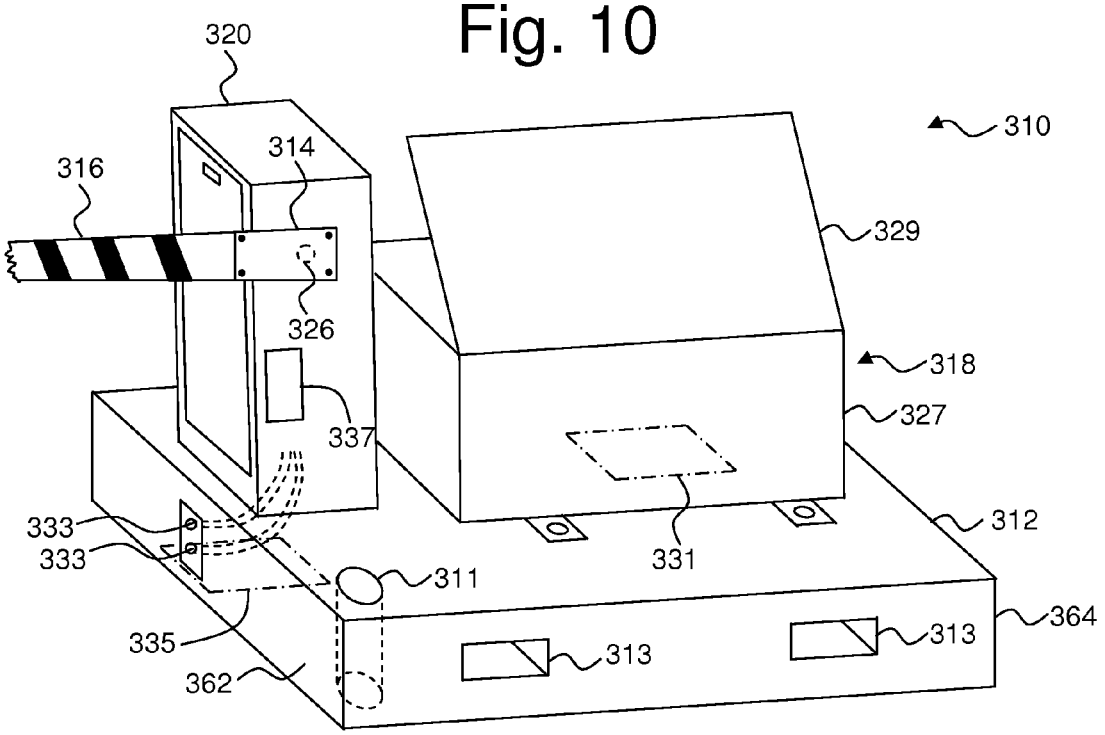
FIG. 10 is a perspective view of a fourth exemplary embodiment of a portable gate or obstruction assembly in accordance with the disclosed subject matter.

FIG. 10 illustrates an exemplary fourth embodiment of a portable gate or obstruction structure 310. The assembly 310 can be positioned across a path (such as path P of FIG. 1) through a secured perimeter to selectively open and close the path to vehicular and/or pedestrian traffic. The assembly 310 can include a base structure 312, a gate support structure 314, a gate or obstruction structure 316, a power source 318 and a drive structure 320 (schematically illustrated). The gate support structure 314, the power source 318 and the drive structure 320 can be attached to the base structure 312. The gate or obstruction structure 316 can be connected to the gate support structure 314 to move between an opened position where the path P is unobstructed by the gate or obstruction structure 316 and a closed position where the gate or obstruction structure 316 prevents passage through the secured perimeter along the path P. FIG. 10 shows the gate or obstruction structure 316 in the closed position. The gate or obstruction structure 316 can extend upwardly in a manner similar to the gate or obstruction structure 116 of FIG. 6.

The base structure 312 can include a first end 362, a second end 364, a post hole 311 and two fork pockets 313 located between the first end 362 and the second end 364 and extending substantially parallel to one or both of the first end 362 and the second end 364. The post hole 311 can be dimensioned and positioned to receive a fence post (omitted from FIG. 10) of the security system. Each fork pocket 313 can be positioned and dimensioned to receive a fork of a forklift truck to facilitate removal and installation of each base structure 312. Any appropriate reinforcement can be added to the base structure 312 to enhance the material strength around the fork pockets 313, as necessary. The base structure 312 can be dimensioned and of sufficient mass to provide a stable platform for the gate or obstruction structure 316 to move between the opened and closed positions. The base structure 312 can have a width extending in a direction away from the path when the base structure 312 is positioned adjacent the path P. The base structure 312 can have a length extending in a direction substantially perpendicular with respect to the width, and can include a height extending in a direction substantially perpendicular to both the width and length. The width can be greater than the length, and the length can be greater than the height. The base structure 312 can be of sufficient mass such that it is resistant to undesired displacement away from the path through the secured perimeter. For example. the base structure 312 can be made from a precast composition of material, such as but not limited to concrete, an aggregate embedded in epoxy, or other appropriate preformable material composition. In the exemplary embodiment of FIG. 10, the base structure 312 can include a precast concrete slab with the fork pockets 313 molded into the precast concrete slab. In an alternate embodiment, the base structure 312 can be fabricated from bricks and mortar, cinder blocks and mortar, iron, steel, or other sufficiently heavy material to provide the desired level of security and structural integrity. The base structure 312 can include a drive structure 320 located thereon that is connected to an obstruction structure that can be configured as a gate 316 that is cantilevered to hang out and away from the first end 362 of the base structure 312.

A gate support structure 314 can be provided to connect the gate 316 to the drive structure 320 on the base 312. The gate support structure 314 can be formed as a bracket or other appropriate structure capable of supporting the gate or obstruction structure 316 in a cantilevered manner.

The drive structure 320 (schematically illustrated) can be mounted to the base structure 312 and can include a drive shaft 326 (shown in phantom) connected to the gate support structure 314. The remainder of the drive structure 320 can be, but is not limited to, a gear drive structure, a kinematic drive structure, or an electric motor direct-drive structure such that the drive shaft 326 is rotated in order to displace the gate or obstruction structure 316 between the closed position and the opened position along the arcuate path. In an alternate embodiment, the drive shaft 326 can be omitted and replaced with a different drive structure such as but not limited to a cable structure, kinematic structure, or a counter-weight structure.

The gate support structure 314 can be connected to the drive shaft 326 so that the gate or obstruction structure 316 can move between the closed position and the opened position along an arcuate path.

FIG. 10 shows the gate or obstruction structure 316 in the closed position. The gate or obstruction structure 316 can be identical in structure and operation to any of the other embodiments of the gate or obstruction structure as disclosed herein.

The power source 318 can include an electrical cabinet 327. The cabinet 327 can include a hinged lid 329 (shown in the open position). The cabinet 327 can house one or more power supply components 331 (shown schematically and in phantom) such as but not limited to wiring, a battery, a generator and a junction for receiving shore power. The power supply component(s) 331 can be in electrical communication with the drive structure 320 to supply power for the operation of the drive structure 320.

The base structure 312 can include one or more conduits, such as loop conduits 333, and a grounding device 335. Each loop conduit can be molded into the base structure 312 during the formation of the base structure 312 and can be configured to retain or run loop wires as well as other types of wires therein. The loop conduits 333 can house one or more electrical conductors (not shown—see, for example, electrical conductors 441 of FIG. 11) connected to a power supply different from the power source 318 and/or connected to other structure(s) of the security system to distribute power from the power source 318. Multiple conduits can be used to prevent cross talk between control wires.

Use of conduits is a common method for enclosing control wires. The use of such a conduit in such a case can be referred to as a loop conduit as the intention is to run loop wires in the conduits, but they could also be used for other control wiring. Multiple conduits can be used to prevent cross talk between control wires. Ground loops are control devices for gate systems—they sense the magnetic field change when vehicles pass over them (sensing steel—not people).

The grounding device 335 (shown schematically and in phantom) can be in electrical communication with one or more of the power supply component(s) 331, as appropriate, and can be configured as a metal plate or a metal bar or other appropriate metal structure. The grounding device 335 can be attached to an outer surface of the base structure 312 or integrally molded with the base structure 312.

A photo-eye 337 can be mounted to an outer surface of the drive structure 320. The photo-eye can be any sensor device that can detect the presence or absence of an object within a predetermined field of view and output a signal indicative of the presence or absence of an object. The photo-eye can be sensitive to light and/or motion within the predetermined field of view. The photo-eye can be in electrical communication with the drive structure 320. The photo-eye 337 can be oriented relative to the path P in order to detect the presence or absence of a vehicle in the immediate vicinity of the portable modular gate or obstruction structure 310. The photo-eye 337 (and other electronic components) can include transmitters and/or receivers that communicate with a CPU or other control device located within the power supply components 331. Thus, the assembly 310 can operate using wireless communication between components, but can also be hard wired for more secure communications between components. Alternatively, the drive structure 320 can be configured with hardware and/or software to process the signal(s) from the photo-eye 337 and/or other sensors to regulate the movement of the gate or obstruction structure 316.

All of the structures of the portable modular gate or obstruction assembly 310 can be mounted to the base structure 312 to allow for ease of installation and removal, when necessary. Further, the power supply for operating the portable modular gate or obstruction assembly 310 is also portable and self-contained. These features can minimize time and labor costs for installation and removal, if necessary, of the portable modular gate or obstruction assembly 310 and can allow for installation in remote or unimproved locations.

Figure 11:
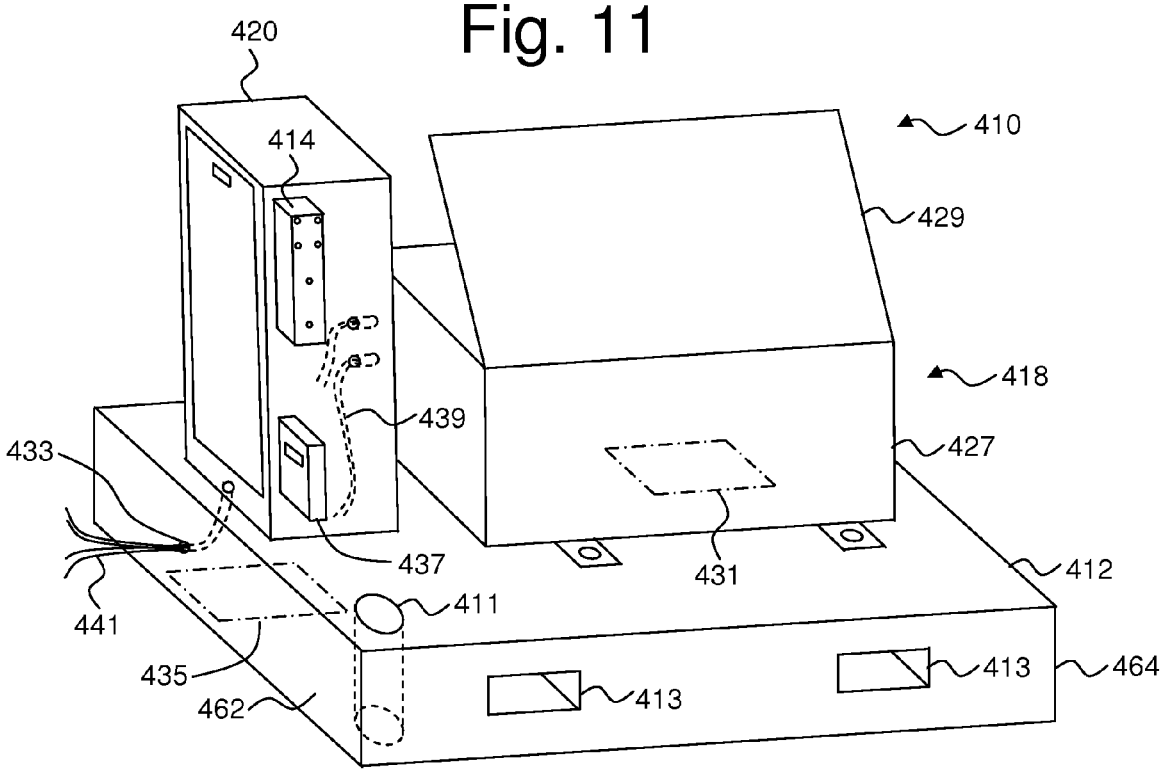
FIG. 11 is a perspective view of a fifth exemplary embodiment of a portable gate or obstruction assembly in accordance with the disclosed subject matter.

FIG. 11 illustrates an exemplary fifth embodiment of a portable gate or obstruction structure 410. The assembly 410 can be positioned across a path (such as path P of FIG. 1) through a secured perimeter to selectively open and close the path to vehicular and/or pedestrian traffic. The assembly 410 can include a base structure 412, a gate support structure 414, a gate or obstruction structure (omitted from FIG. 11), a power source 418 and a drive structure 420 (schematically illustrated). The gate support structure 414, the power source 418 and the drive structure 420 can be attached to the base structure 412. The gate or obstruction structure can be connected to the gate support structure 414 to move between an opened position where the path P is unobstructed by the gate or obstruction structure and a closed position where the gate or obstruction structure prevents passage through the secured perimeter along the path P. FIG. 11 shows the gate support structure 414 in the opened position such that the gate or obstruction structure can extend upwardly in a manner similar to the gate or obstruction structure 116 of FIG. 6.

The base structure 412 can include a first end 462, a second end 464, a post hole 411 and two fork pockets 413 located between the first end 462 and the second end 464 and extending substantially parallel to one or both of the first end 462 and the second end 464. The post hole 411 can be dimensioned and positioned to receive a fence post (omitted from FIG. 11) of the security system. Each fork pocket 413 can be positioned and dimensioned to receive a fork of a forklift truck to facilitate removal and installation of each base structure 412. Any appropriate reinforcement can be added to the base structure 412 to enhance the material strength around the fork pockets 413, as necessary. The base structure 412 can be dimensioned and of sufficient mass to provide a stable platform for the gate or obstruction structure to move between the opened and closed positions. The base structure 412 can be constructed similar to that of the embodiment of FIG. 10.

The gate support structure 414 can be formed as a bracket or other appropriate structure capable of supporting the gate or obstruction structure in a cantilevered manner.

The drive structure 420 (schematically illustrated) can be mounted to the base structure 412. The drive structure 420 can include a drive shaft (omitted from FIG. 11) connected to the gate support structure 414 in a manner similar to the draft shaft 326 of FIG. 10. The remainder of the drive structure 420 can be, but is not limited to, a gear drive structure, a kinematic drive structure, or an electric motor direct-drive structure such that the drive shaft is rotated in order to displace the gate or obstruction structure between the closed position and the opened position along the arcuate path. In an alternate embodiment, the drive shaft can be omitted and replaced with a different drive structure such as but not limited to a cable structure, kinematic structure, or a counter-weight structure.

The gate support structure 414 can be connected to the drive shaft so that the gate or obstruction structure can move between the closed position and the opened position along an arcuate path.

FIG. 11 shows the gate support structure 414 in the closed position. The gate or obstruction structure can be identical in structure and operation to the gate or obstruction structure any of the disclosed embodiments.

The power source 418 can include an electrical cabinet 427. The cabinet 427 can include a hinged lid 429 (shown in the open position). The cabinet 427 can house one or more power supply components 431 (shown schematically and in phantom) such as but not limited to wiring, a battery, a generator and a junction for receiving shore power. The power supply component(s) 431 can be in electrical communication with the drive structure 420 via electrical conductors 439 to supply power for the operation of the drive structure 420. The electrical conductors 439 can be housed within one or more conduits.

The base structure 412 can include one or more loop wires 433 and a grounding device 435. Each loop wire can be molded into the base structure 412 during the formation of the base structure 412. The loop wires 433 can be configured as electrical conductors 441 connected to a power supply different from the power source 418 and/or connected to other structure(s) of the security system to distribute power from the power source 418. For example, the loop wires 433 can be located within a loop conduit, and the loop conduit can be considered a conduit for wired gate control devices.

The grounding device 435 (shown schematically and in phantom) can be in electrical communication with one or more of the power supply component(s) 431, as appropriate. The grounding device 435 can be configured as a metal plate or a metal bar or other appropriate metal structure. The grounding device 435 can be attached to an outer surface of the base structure 412 or integrally molded with the base structure 412.

A sensor, such as a photo-eye 437, can be mounted to an outer surface of the drive structure 420. The photo-eye can be any sensor device that can detect the presence or absence of an object within a predetermined field of view and output a signal indicative of the presence or absence of an object. The photo-eye 437 can be sensitive to light and/or motion within the predetermined field of view, or can be a weight, vibration, or magnetic sensor. The photo-eye 437 can be in electrical communication with the drive structure 420. The photo-eye 437 can be oriented relative to the path P in order to detect the presence or absence of a vehicle in the immediate vicinity of the portable modular gate or obstruction structure 410. The drive structure 420 can be configured with hardware and/or software to process the signal(s) from the photo-eye 437 and regulate the movement of the gate or obstruction structure.

All of the structures of the portable modular gate or obstruction assembly 410 can be mounted to the base structure 412 to allow for ease of installation and removal, when necessary. Further, the power supply for operating the portable modular gate or obstruction assembly 410 is also portable and self-contained. These features can minimize time and labor costs for installation and removal, if necessary, of the portable modular gate or obstruction assembly 410 and can allow for installation in remote or unimproved locations.

Figure 12:
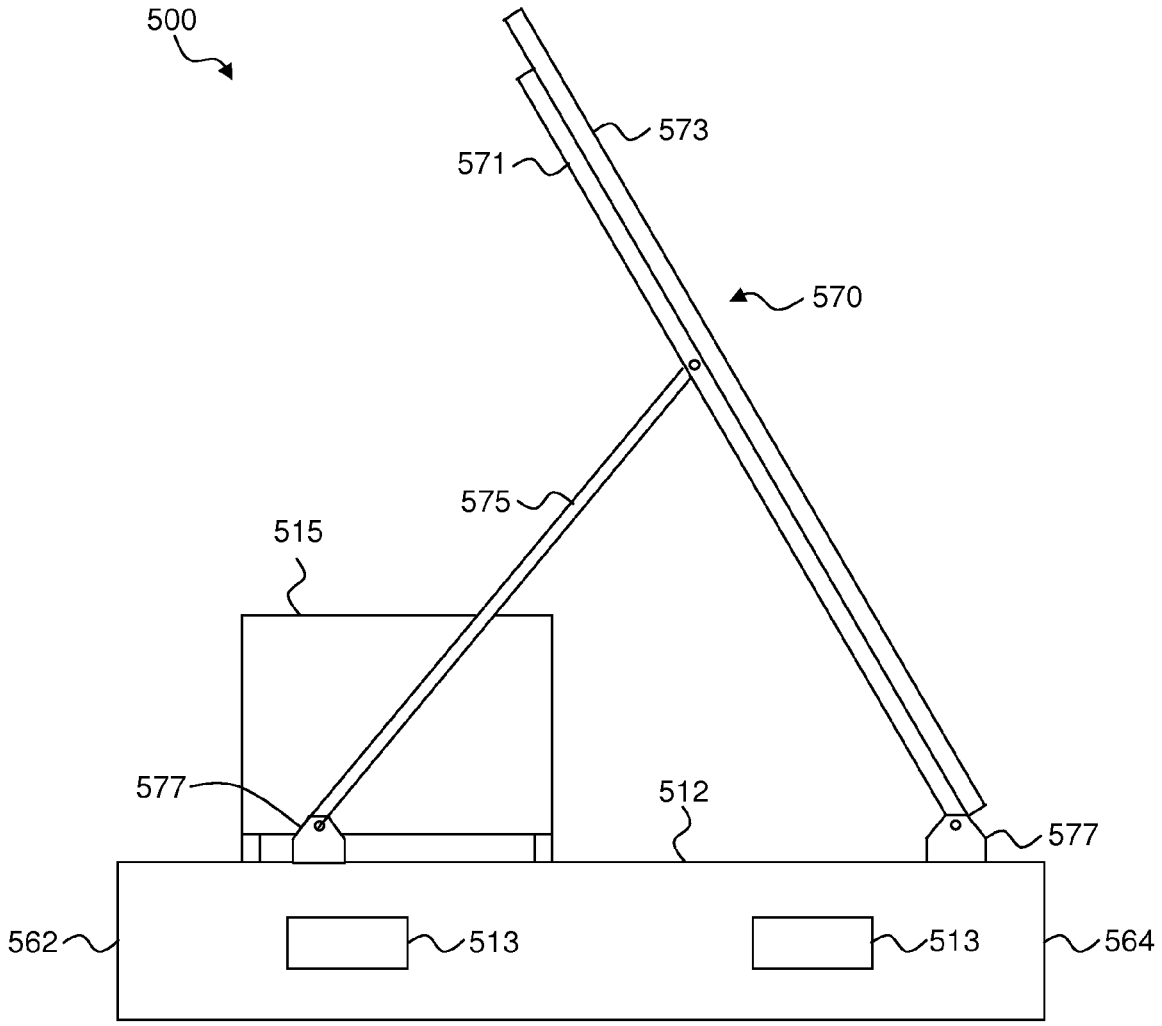
FIG. 12 is a side view of a solar panel module in accordance with the disclosed subject matter.

FIG. 12 illustrates a portable solar panel module 500 that can include a base structure 512, a fork pocket 513, a storage box 515 and a solar panel structure 570. The portable solar panel module can supplement or replace any of the solar panel structures 70, 72, 170, 270 described above. The portable solar panel module 500 can also be combined with the power sources 418, 518 described above as a back-up source of power. Alternatively, the portable solar panel module 500 can also replace or complement the power sources 318, 418 described above.

The base structure 512 can include a first end 562, a second end 564 and two fork pockets 513 located between the first end 562 and the second end 564 and extending substantially parallel to one or both of the first end 562 and the second end 564. Each fork pocket 513 can be positioned and dimensioned to receive a fork of a forklift truck to facilitate removal and installation of each base structure 512. Any appropriate reinforcement can be added to the base structure 512 to enhance the material strength around the fork pockets 513, as necessary. The base structure 512 can be configured similar to the base structure of any of the other disclosed embodiments.

The solar panel structure 570 can include a frame 571, one or more solar panels 573, an adjustment mount frame 575 and a plurality of pivot bases 577. The solar panel(s) 573 can be secured to the frame 571. One end of the frame 571 can be pivotally mounted to a pair of pivot bases 577 on the base 512. The adjustable mount frame 575 can be rotatably and/or slidably secured to the frame 571 by any appropriate releasable connection, such as but not limited to bolts/nuts, screws with or without nuts, ball and detent assembly, ratchet assembly, or spring biased pins and mating holes, etc. This arrangement can provide adjustment of the solar panels 573 for optimal solar energy collection.

The base structure 512 can include one or more conduits (such as conduits 333 of FIG. 10) for housing electrical conductors to distribute power from the solar panel(s) to the power source and/or other electrical equipment of the security system.

Figure 13:
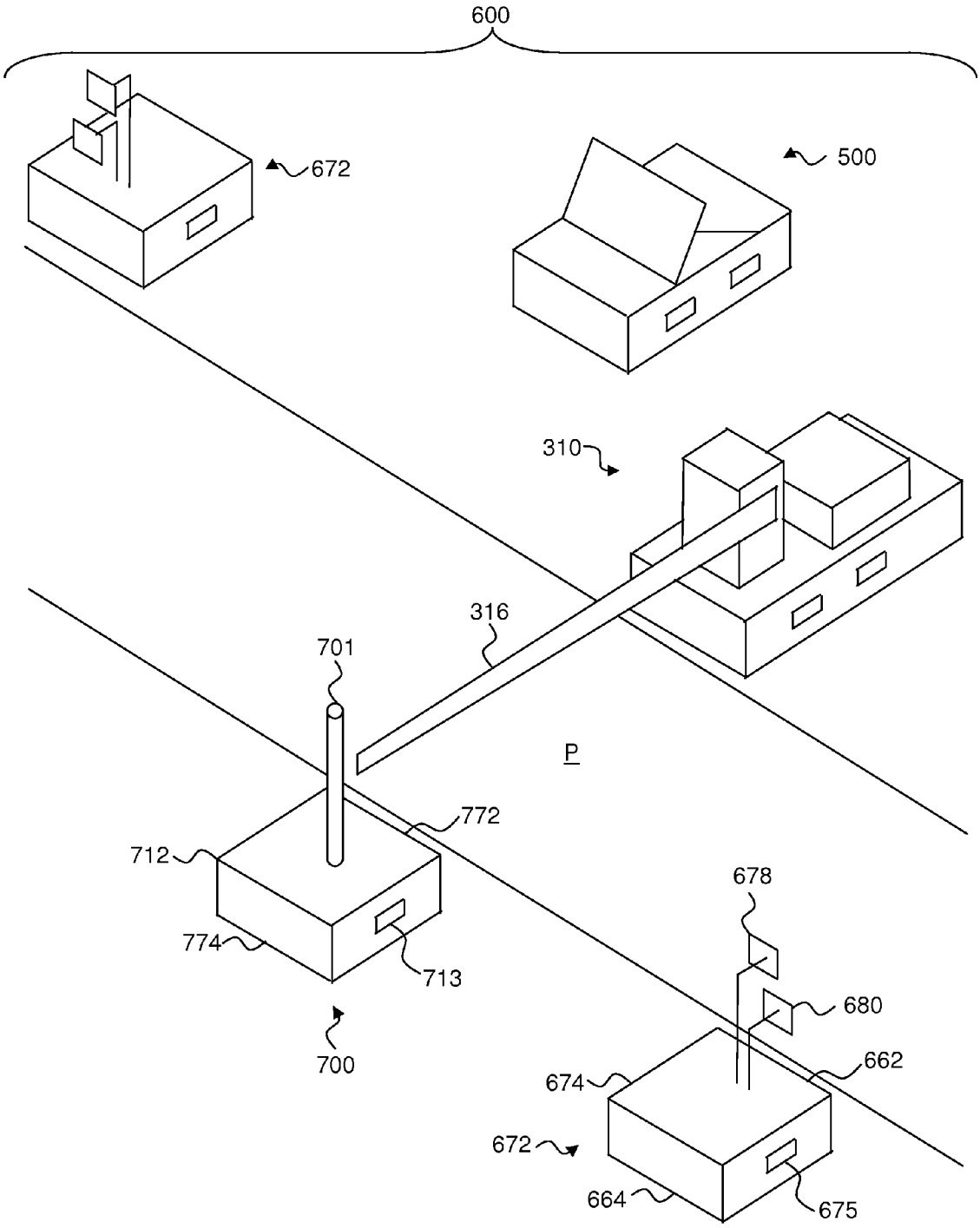
FIG. 13 is perspective view of a perimeter security system in accordance with the disclosed subject matter.

FIG. 13 illustrates an exemplary partial layout of a security system 600 to secure passage along the path P in accordance with the disclosed subject matter. The system can include any one of the portable modular gate or obstruction assemblies 10, 110, 210, 310, 410 described above, a portable solar panel module 500, a pair of portable access control modules 672, and a portable gate post module 700. FIG. 13 illustrates the exemplary use of a portable modular gate or obstruction assembly 312 of FIG. 10 and an exemplary portable solar panel module 500 of FIG. 12. The portable solar panel module 500 can be in electrical communication with the portable modular gate or obstruction assembly 312, and each of the portable access control modules 672. The portable modular gate or obstruction assembly 312 can be in electrical communication with the portable access control modules 672.

One of the portable access control modules 672 can be positioned on the unsecured side of security system 600 to permit access into the secured side of the security system 600. The other of the portable access control modules 672 can be positioned on the secured side of security system 600 to permit access out the secured side of the security system 600.

Each of the portable access control modules 672 can include a base structure 674, a sign in desk structure 678 and a wireless keypad structure 680. The base structure 674 can include a first end 662, a second end 664 and a fork pocket 675 located between the first end 662 and the second end 664 and extending substantially parallel to one or both of the first end 662 and the second end 664. The fork pocket 675 can be positioned and dimensioned to receive a fork of a forklift truck to facilitate removal and installation of each base structure 674. Any appropriate reinforcement can be added to the base structure 674 to enhance the material strength around the fork pocket 675, as necessary. The base structure 674 can otherwise be formed in a similar manner as compared to any of the other disclosed base structures.

The solar panel structure, the sign-in desk or control structure 678, and the wireless keypad 680 can be secured to the base structure 674 by casting the material of the base structure around the solar panel structure, a sign in desk or control structure 678, and a wireless keypad 680. In another alternate embodiment, the solar panel structure, the sign in desk or control structure 678 and the wireless keypad 80 can be secured to fasteners affixed to the base structure 674.

The sign-in desk or control structure 678 can receive and display information regarding the authorized passage of pedestrians and vehicular traffic through the path P. The structure 678 can also include computer controls, such as a programmable logic controller or other type of controller that assists or controls the operation of the gate system, as well as sensors for keyless entry and the like. The base structure 674 could include wireless or satellite communications capability that would allow the security system 600 to communicate with remote operators or remote computers to control operation of the system. The control structure 678 can also include a camera or multiple cameras that would allow further remote operability for the system. For example, an operator at an off-location site can use a camera to view an entity requesting entry via the gate system. If authorized, the operator can wirelessly (or otherwise) actuate the system to operate the gate structure for access (or denial of access) along the pathway in which the system is installed.

All of the structures of the portable access control module 672 can be mounted to the base structure 674 to allow for ease of installation and removal, when necessary. Further, the power supply for operating the portable access control module 672 is also portable and self-contained. These features can minimize time and labor costs for installation and removal, if necessary, of the portable access control module 672 and can allow for installation in remote or unimproved locations.

The portable gate post module 700 can be positioned along the path P in alignment with the gate or obstruction structure 316. The portable gate post module can include a post 701 and a base structure 712.

The base structure 712 can include a first end 762, a second end 764 and a fork pocket 713 located between the first end 762 and the second end 764 and extending substantially parallel to one or both of the first end 762 and the second end 764. The fork pocket 713 can be positioned and dimensioned to receive a fork of a forklift truck to facilitate removal and installation of each base structure 712. The base structure can be constructed similar to the other base structures of the disclosed subject matter.

The post 701 can be secured to a hole formed in the base structure 712, or the post can be integrally molded with the base structure 712. The post 701 can include one or more reflective marking and/or a light source. The light source can be in electrical communication with the portable modular gate or obstruction assembly 310 and/or with the portable solar panel module 500.

While certain embodiments of the invention are described above, it should be understood that the invention can be embodied and configured in many different ways without departing from the spirit and scope of the invention. For example, the solar panel structure or the battery can be the primary power source that powers the drive structure and the other can be a back-up. In another exemplary embodiment any combination of the power source structure and the drive structure can be mounted on a base structure separate from the base structure to which the gate or obstruction structure is mounted. The hanger assembly 24 can be secured to the support post 28 in any appropriate method such as but not limited to integrally forming with the support post 28, welding, or fasteners extending through the hanger structure 24 and the support post 28.

The base 12, 112, 212 is described as being modular and including the gate support structure integrally molded therein. However, it should be understood that the integral mold can comprise a tubular mount structure to which a separate portion of the gate support structure is mounted once the system arrives at an installation site. Similarly, tube structures can be provided and molded into the base 12, 112, 212 for attachment to the gate support structure, the power source structure and the control structure when the system arrives at an installation site.

The base 12, 112, 212 can include securing points (such as rings, forklift slots, and the like) that allow a front end loader or forklift or other construction equipment to quickly and easily move the system as a modular unit from a transportation vehicle to an appropriate location at an installation site.

In addition, the base can be configured to be optionally or selectively crash resistant. For example, the base (as well as the gate panels and other structures of the module) can be formed from hollow structures that can be filled with different types of material depending on the application. In one embodiment, where the gate module is to be used to secure the perimeter of a location that is subject to attack by vehicle, the hollow components of the module can be filled with sand, sludge, water, metal, or other dense material or composite, that would provide a desired mass for the module, thus increasing the crash resistance of the gate module. It is also contemplated that the base structure and/or gate panel(s) can be made larger to provide crash resistance for the gate module. Alternatively, each of the components can be reinforced by additional structure or treatments. In one embodiment, the base can be reinforced with rebar or additional strengthening bars that are placed within the base before or during any curing process that might occur. The gate panels can also be reinforced with a rebar type system, or by simply including a larger number of cross-bars and structural components.

Alternatively, the base structure and gate structure can be configured to include crumple zones in which at least one dampening structure is included in any of the structures to dampen or transmit a crash force such that the gate and base structure return substantially to their original shape to ensure continued operation of the gate structure (e.g., to ensure prevention of a breach of the gate structure by pedestrians or vehicles). In particular, any of the structures can include a dampening material integrally attached or attached as separated dampers, designed to absorb the kinetic energy from a crash event before the energy is transferred to the critical components of the gate structure, such as the gate panel structure, gate post structure, or gate base structure.

The gate structure is shown as both a cantilevered post type gate (for example, as shown in FIGS. 7 and 10) and a panel fence type gate (for example, as shown in FIGS. 1-6). It should be understood that the panel fence type gate can be incorporated in any of the embodiments in which the cantilevered post type gate is depicted, and vice versa. In addition, it should be noted that the panel fence can include any of various types of panel in fill, such as chain link, pickets, perforated mesh, scrolls, initials, etc., in any of the embodiment depicted or described herein.

While the subject matter has been described in detail with reference to exemplary embodiments thereof, it will be apparent to one skilled in the art that various changes can be made, and equivalents employed, without departing from the scope of the invention. All related art references discussed in the above Description of the Related Art section are hereby incorporated by reference in their entirety.

What is claimed is:

1. A portable gate module for selectively opening and closing a path, the portable gate module comprising:

a base structure configured to be removably positionable adjacent the path, the base structure having a first end configured to lie adjacent the path when the portable gate module is positioned adjacent the path, and the base structure having a second end spaced from the first end and configured to be spaced from the path when the portable gate module is positioned adjacent the path;

a gate support structure secured to the base structure;

a gate panel structure including a frame, the gate panel structure cantilevered to the gate support structure and movable between an opened position where the gate panel structure is configured to open the path when the portable gate module is positioned adjacent the path and a closed position where the gate is configured to close the path when the portable gate module is positioned adjacent the path;

a power source located on the base structure; and a drive structure connected to the power source and coupled to the gate panel structure to displace the gate panel structure between the opened positioned and the closed position.

2. The portable gate module according to claim 1, wherein the gate panel structure is movable between the opened position and the closed position along a linear path.

3. The portable gate module according to claim 1, wherein the gate panel structure is movable between the opened position and the closed position along an arcuate path.

4. The portable gate module according to claim 1, wherein:

the gate panel structure includes a first vertical pole structure at a first end and a second vertical pole structure at a second end;

the gate panel structure first end lies adjacent the base structure first end when the gate is in the opened position;

the gate panel structure second end is cantilevered from the support structure in a direction away from the base structure first end and toward the base structure second end when the gate is in the opened position;

the gate panel structure second end lies intermediate the base structure first end and the base structure second end when the gate panel structure is in the closed position; and the gate panel structure first end is cantilevered from the support structure in a direction away from the base structure second end and toward the base structure first end when the gate is in the closed position.

5. The portable gate module according to claim 1, wherein:

the gate panel structure includes a first vertical pole structure at a first end and a second vertical pole structure at a second end;

the gate panel structure first end is cantilevered from the support structure in a direction away from the base structure second end and toward the base structure first end when the gate is in the opened position and in the closed position.

6. The portable gate module according to claim 1, wherein:

the gate panel structure includes a gate first end and a gate second end;

when the portable gate module is positioned adjacent the path and the gate is in the opened position, the gate first end is adjacent the base structure first end and the gate second end is spaced from the base structure first end in a direction away from the path, such that the gate opens the path; and when the portable gate module is positioned adjacent the path and the gate is in the closed position, the gate first end is spaced from the base structure first end and the gate second end lies adjacent the base structure first end such that the gate spans the path.

7. The portable gate module according to claim 1, wherein the base structure includes a precast concrete slab.

8. The portable gate module according to claim 1, wherein the power source includes a battery, and the drive structure is electrically connected to the battery.

9. The portable gate module according to claim 1, wherein the power source includes:

a battery; and a solar energy collection structure in electrical communication with the battery.

10. The portable gate module according to claim 1, wherein the base is made from a precast composition of material; and the gate support structure includes a beam made from at least one of metal, wood, and plastic, the beam being precast in the base structure such that the precast composition of material is in continuous contact with and completely surrounds an entire periphery of the beam.

11. The portable gate module according to claim 1, wherein the frame of the gate panel structure includes a first vertical beam and a second vertical beam and an in-fill spanning between the first vertical beam and second vertical beam.

12. The portable gate module according to claim 11, wherein the in-fill includes chain link fence.

13. The portable gate module according to claim 1, wherein the base structure is a hollow plastic structure configured to be filled with a material when located adjacent the path.

14. A portable obstruction module for selectively opening and closing a path, the portable obstruction module comprising:

base structure made from a precast composition of material and configured to be removably positioned adjacent the path, the base structure having a width extending in a direction away from the path when the base structure is positioned adjacent the path, the base structure having a length extending in a direction substantially perpendicular with respect to the width, and the base structure including a height extending in a direction substantially perpendicular to both the width and length, the width being greater than the length, and the length being greater than the height;

a support structure attached to the base structure;

an obstruction structure mounted on the support structure and one of moveable and rotatable with respect to the support structure;

a power source located on the base structure; and a drive structure connected to the power source and coupled to the obstruction structure to displace the obstruction structure between an opened position where the obstruction structure is configured to open the path when the portable obstruction module is positioned adjacent the path and a closed position where the obstruction structure is configured to close the path when the portable gate module is positioned adjacent the path.

15. The portable obstruction module according to claim 14, wherein the obstruction structure includes:

a frame structure one of pivotally and slidably mounted with respect to the support structure; and a chain link fencing connected to and spanning the frame structure.

16. The portable obstruction module according to claim 14, wherein the obstruction structure includes a traffic arm pivotally mounted to the support structure.

17. The portable obstruction module according to claim 14, wherein the base structure includes a precast concrete slab.

18. The portable obstruction module according to claim 14, wherein the power source includes a battery and the drive structure is electrically connected to the battery.

19. The portable obstruction module according to claim 14, wherein the power source includes:

a battery; and a solar energy collection structure in electrical communication with the battery.

20. The portable obstruction module according to claim 14, wherein the support structure includes a beam made from at least one of metal, wood, and plastic, the beam being precast in the base structure such that the precast composition of material is in continuous contact with and completely surrounds an entire periphery of the beam.

21. A method for selectively opening and closing access to a path comprising:

providing a portable gate module including, a base structure, a gate support structure secured to the base structure, a gate panel structure having a frame cantilevered to the gate support structure and movable between an opened position and a closed position, a power source secured to the base structure, and a drive structure connected to the power source and coupled to the gate panel structure to displace the gate panel structure between the opened positioned and the closed position; and moving the base structure and gate panel structure in unison and as a single unit to a location adjacent the path such that the gate panel structure is configured to cross the path when in the closed position.

* * * * *